US007886384B2

(12) United States Patent
Lord

(10) Patent No.: US 7,886,384 B2
(45) Date of Patent: Feb. 15, 2011

(54) SLEEP AID ALONG WITH METHOD INCORPORATING SAME

(75) Inventor: John Lord, Denver, CO (US)

(73) Assignee: Summer Infant (USA), Inc., Woonsocket, RI (US)

( * ) Notice: Subject to any disclaimer, the term of this patent is extended or adjusted under 35 U.S.C. 154(b) by 0 days.

(21) Appl. No.: 12/014,645

(22) Filed: Jan. 15, 2008

(65) Prior Publication Data

US 2008/0172794 A1 Jul. 24, 2008

Related U.S. Application Data

(63) Continuation-in-part of application No. 12/013,382, filed on Jan. 11, 2008.

(60) Provisional application No. 60/897,740, filed on Jan. 24, 2007.

(51) Int. Cl.
*A47C 20/02* (2006.01)

(52) U.S. Cl. ..... 5/655; 5/657; 5/632

(58) Field of Classification Search ..... 5/655, 5/657, 722, 640, 632
See application file for complete search history.

(56) References Cited

U.S. PATENT DOCUMENTS 3,659,297 A * 5/1972 Schutz ..... 5/655
3,721,434 A * 3/1973 Spies ..... 5/655
5,718,011 A * 2/1998 Nogues ..... 5/655
6,877,176 B2 * 4/2005 Houghteling ..... 5/655
7,213,281 B2 * 5/2007 Hahn et al. ..... 5/655

OTHER PUBLICATIONS

Related U.S. Appl. No. 12/019,599 filed: Jan. 24, 2008 Inventor: John Lord.

* cited by examiner

*Primary Examiner*—Fredrick Conley
(74) *Attorney, Agent, or Firm*—Sunstein Kann Murphy & Timbers LLP

(57) ABSTRACT

Provided is a sleep aid for use in reducing the risk of plagiocephaly including a cushion and a sleep position indicator. The cushion includes an elongate pad to accommodate a person in a reposed position such that the person extends along a longitudinal axis of the pad. The cushion also includes a casing surrounding the pad that has bottom and top panels. The sleep position indicator has an elongate dimension and is slideably supported by the cushion. A medial portion of the sleep position indicator is adapted to move transversely to the longitudinal axis within a slideway. The indicator may be moved between a first position where it visibly protrudes from a first side of the cushion to inform a first head orientation, and a second position where it visibly protrudes from a second side of the cushion to inform a second head orientation.

18 Claims, 7 Drawing Sheets

SLEEP AID ALONG WITH METHOD INCORPORATING SAME

CROSS-REFERENCE TO RELATED APPLICATIONS

The present application is a continuation-in-part of U.S. nonprovisional application Ser. No. 12/013,382 filed on Jan. 11, 2008, which claims the benefit of U.S. provisional application Ser. No. 60/897,740 filed on Jan. 24, 2007, the disclosure of which is incorporated by reference in its entirety.

BACKGROUND

According to many medical experts, infants who sleep on their back or side have a reduced risk of dying from Sudden Infant Death Syndrome (SIDS) when compared to those who sleep on their stomachs. Starting in 1992, the American Academy of Pediatrics began recommending that infants sleep on their back/side in an effort to reduce the incidence of SIDS. One of the theories being that small infants with little or no control of their heads may, while face down, smother themselves on their bedding. In an effort to reduce the risk of SIDS, various infant sleep aids, such as infant sleep positioners, have been developed. For example, the INFANT SUPPORT SYSTEM as described in U.S. Pat. No. 6,877,176 B2, issued Apr. 12, 2005 to Houghteling, includes a cushion for supporting an infant and includes positioning support members for maintaining the infant in a safe sleeping position. In addition, the casing of the cushion includes breathable material to help prevent suffocation.

Since the recommendation of the American Academy of Pediatrics that infants sleep lying on their back/side, infants are more often placed in a supine position for sleeping. An unanticipated effect of the supine sleeping position is an increase in the number of infants developing deformational or positional plagiocephaly. Positional plagiocephaly is characterized by a flat spot on the back or one side of the infant's head. Positional plagiocephaly is caused by the infant's head remaining in one position for too long or being repeatedly positioned in the same manner while sleeping. A newborn infant's skull is relatively deformable due to flexibility of the bone plates and non-fusion between adjacent bone plates. This flexibility allows the infant's skull to pass through the mother's pelvis during birth, but also allows the skull to deform if it remains in one place for too long. Experts now recommend that infants sleep on their back with their head positioned on one side or the other to prevent a flat or misshapen area in the back of their skull. However, if an infant spends too much time sleeping with his/her head positioned on the same side, plagiocephaly may occur on the side of the infant's head. If the weight of the infant's head is allowed to exert pressure on the same side of the infant's head for too long, the skull deformation may become permanent.

In an effort to reduce the instances of plagiocephaly while continuing to protect infants against the possibility of SIDS, some manufacturers have marketed infant positioners that encourage an infant's parents to place the infant on his/her back with a reminder to indicate which way to position the infant's head within the sleep positioner. Specifically, the INFANT SAFETY SYSTEM described in U.S. Pat. No. 7,213,281 B2, issued May 8, 2007 to Hahn, includes a concave back support and abdominal support for positioning an infant on its side. The position marker is attached to the infant positioner with Velcro and may be moved from side to side to indicate how to position the infant within the positioner. The position marker is intended to remind the parent to alternate the positioning of the infant to help ensure the infant does not spend too much time with his/her head on one side.

While current products appear helpful in reducing the instances of SIDS and plagiocephaly, there is still room for improvement in the areas of convenience and versatility for sleep aids in general, sleep position indicators in particular. Similarly, it is believed that the breathability features of infant sleep positioners can be enhanced to further reduce cases of sudden infant death. Accordingly, there is a need for infant sleep aids that have enhanced breathability. Also, there is a need for a more versatile sleep position indicator that it is simpler to use, thereby encouraging its use.

SUMMARY

The present invention provides, in one sense, a sleep aid for use as a reminder of how to orient an individual on a sleeping or resting surface, such as a pad, to help reduce instances of plagiocephaly. In another sense, the invention relates to a pad construction upon which an individual can rest or sleep, which pad construction greatly reduces, if not altogether eliminates, the chance of suffocation. The ordinarily skilled artisan will appreciate that each of these advantages can be realized individually or together in a common sleep aid.

While various terms may be used throughout the description to follow, each one of these terms should certainly not be construed in a limiting sense. For example, while the description to follow describes the various embodiments in the context of an infant either resting or asleep on a sleep aid, it should be appreciated that the teachings herein can be employed with any suitably sized and configured sleep aid for which an individual might benefit. Thus, the individual need not be an infant, but could be a patient or other physically handicapped individual whose resting or sleeping position needs to be closely monitored and adjusted from time to time. Furthermore, the term "sleep" as used herein should not be construed in a limiting sense to imply that the various embodiments can only be employed in circumstances where an individual needs to actually fall asleep, but rather more broadly contemplates any circumstance in which an individual might need to assume a reposed position or otherwise be positioned on a surface in a particular manner, wherein such environment might benefit from a position reminder system as discussed herein. Finally, where various device constructions are described for use with an infant to alleviate, if not eliminate, the risk of suffocation, other individuals could likewise benefit from the teachings herein. Infants, for example, are not physically developed to the extent that they have sufficient muscle control in the neck and other regions to move their head from side to side without assistance. The same could be true for individuals of any age having physical conditions which also require the assistance of caretakers. Then, such individuals could also benefit from the teachings herein.

In accordance with the above objectives, broadly provided is a sleep aid which comprises a panel piece having a support surface for an individual's upper body portion when in a reposed position and a selected width. A sleep position indicator is movably disposed beneath the surface between a first position which visually informs a first head position for the individual and a second position which visually informs a second head position for the individual.

Preferred embodiments relate to an infant sleep aid for use in reducing a risk of plagiocephaly. The infant sleep aid comprises a cushion for placement on a support surface and a sleep position indicator supported by the cushion. The cushion includes an elongate pad having a selected configuration which is sized and adapted to accommodate an infant when placed thereon in a reposed position such that the infant extends along a longitudinal axis of the pad. A casing surrounds the pad and has a bottom panel for confronting the support surface and a top panel providing a support for the infant when placed thereon. This top panel has a head portion. The sleep position indicator has an elongate dimension greater than a width of the head portion. A medial portion of the indicator is adapted to move transversely through the longitudinal axis within a slideway between a first position wherein a first end portion of the indicator visibly protrudes from a first side of the cushion to inform a first head orientation for the infant, and a second position wherein a second end portion of the indicator visibly protrudes from a second side of the cushion to inform a second head orientation for the infant.

Also contemplated is a method for reducing a risk of plagiocephaly in infants. According to the method, an elongate cushion and a sleep position indicator are provided. The sleep position indicator is placed in either a first or second position. The infant is placed in a reposed position on the support such that the infant's head is orientated in one of a first and second direction. The infant remains in this position for a selected interval of time, after which the sleep position indicator may be moved to the other position and the infant may be re-situated with his/her head orientated in the other direction.

These and other objects of the present invention will become more readily appreciated and understood from a consideration of the following detailed description of the exemplary embodiments when taken together with the accompanying drawings, in which:

BRIEF DESCRIPTION OF THE DRAWINGS

FIG. 3(*b*) is a top plan view of the infant sleep aid shown in FIG. 1, and with the infant asleep in a second sleep position;

DETAILED DESCRIPTION OF THE EXEMPLARY EMBODIMENTS

Figure 1:
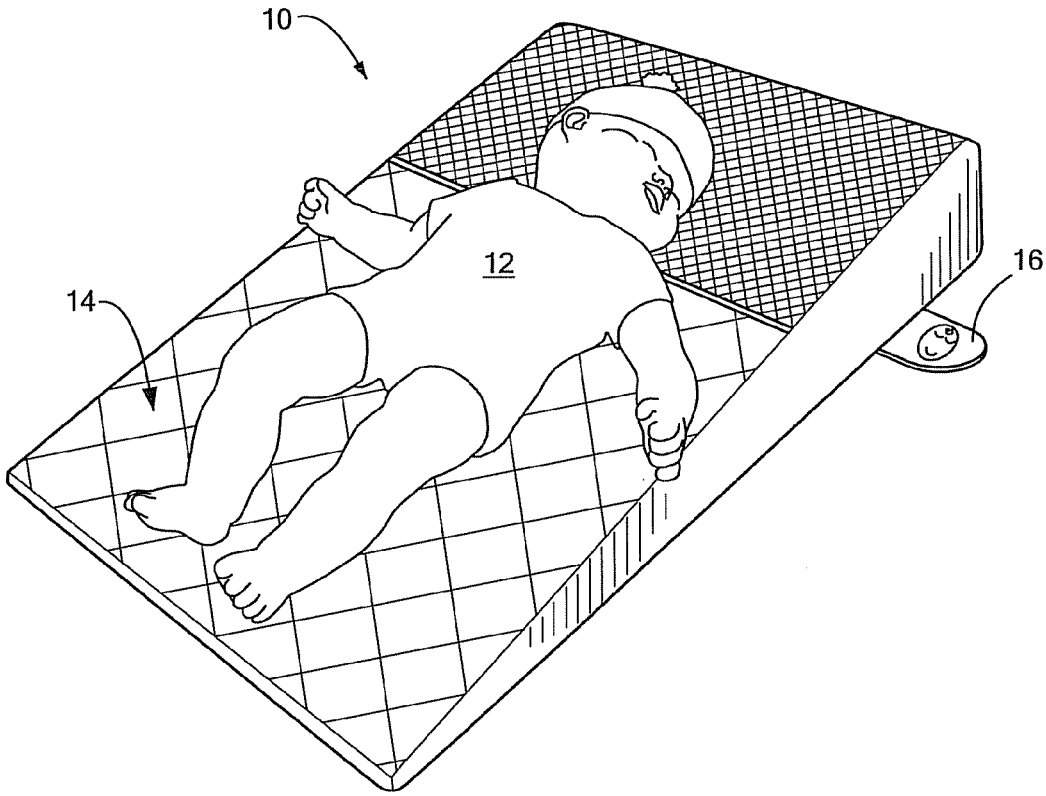
FIG. 1 is a perspective view of an infant asleep in a reposed position on an infant sleep aid according to a first exemplary embodiment.

Initial reference is made to FIG. 1 which introduces a first exemplary embodiment of a sleep aid 10. Sleep aid 10 is sized and adapted for use with an infant 12 and, to this end, can be considered an infant sleep aid. Sleep aid 10 broadly comprises a support shown here to be in the form of a cushion 14 and a sleep position indicator 16. Support 14 is a wedge-shaped cushion employed as a sleep positioner. This cushion is constructed similarly to the support cushion used in the INFANT SUPPORT SYSTEM described in U.S. Pat. No. 6,877,176 B2, issued Apr. 12, 2005 to Houghteling, the disclosure of which is incorporated by reference in its entirety.

Figure 2:
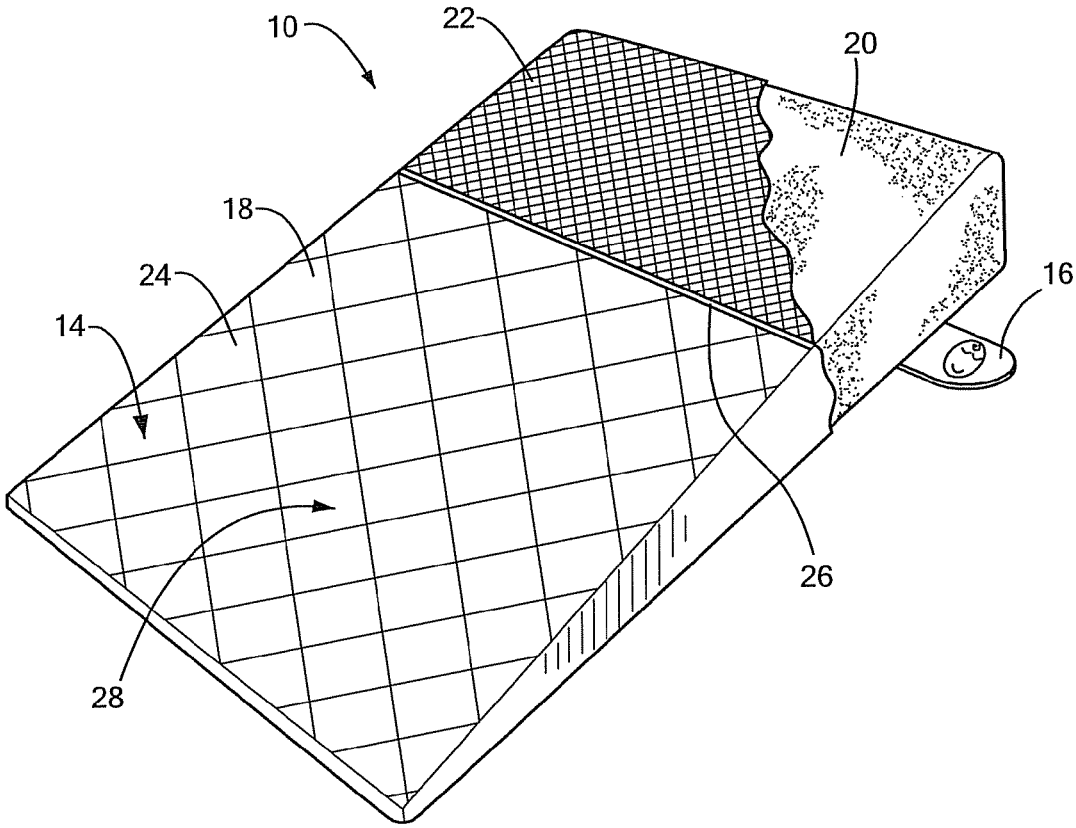
FIG. 2 is a perspective view, partially broken away, of the infant sleep aid of FIG. 1.

As such, and with reference to FIG. 2, the sleep aid's support cushion 14 is generally constructed of a casing 18 which receives a resilient pad 20 in a close-fitted relationship. Further, casing 18 can be constructed of various panel sections including a head panel 22 and foot panel 24, which have respective confronting edges and are stitched or otherwise joined (permanently or releasably) together to form junction 26. Head and foot panels 22 and 24, thus, form a continuous, two-piece top panel 28 which may be joined to a one-piece bottom panel 30 (FIGS. 4 & 5) about the majority of its peripheral margin.

While there are a variety of materials which can be employed for cushion 14, it has been surprisingly found that certain materials in combination can be employed to substantially reduce, if not eliminate, the risk of suffocation during use. To this end, head panel portion 22 is preferably a 100% polyester or "sandwich fabric" currently utilized, for example, in various infant-related products marketed by Basic Comfort, Inc. of Denver, Colo. under the trademark Flothru™. Further, it is desired that foot panel 24 be formed as a tri-layer polyester construction that includes an outer layer that is 100% polyester tricot, a bottom layer that is 100% polyester fine mesh, and an intermediate layer that is 100% polyester fiber. The remainder of the casing may also be formed of this material but could, alternatively, be formed of a fabric that is 50% cotton and 50% polyester. The materials for the casing are, therefore, consistent with those described in the above-incorporated '176 patent to Houghteling.

It is thought, however, to be unique to utilize such a casing construction in conjunction with a resilient pad 20 that is preferably formed as a 100% polyurethane open cell foam, sometimes referred to as reticulated foam. Recently, foam of this type has enjoyed widespread use in outdoor applications, such as cushions for outdoor patio furniture, due to its fast-drying characteristics and ease of cleaning. Reticulated foam allows bodily fluids to pass straight through pad 20 which helps to provide a drier surface for the infant to lie on. Cleaning reticulated foam is also much easier because the fluid does not absorb into the pad. Indeed, these pads have traditionally been formed of regular closed cell foam or memory foam, which has the tendency to trap fluids, thus making them more difficult to clean. It has been found that when reticulated foam is used in conjunction with the Flothru™ material, or equivalent, there is an additional advantage of breathability which can help prevent suffocation. Accordingly, one of the aspects of the teachings herein is the provision of a sleep aid which exhibits one or a combination of the characteristics of breathability to substantially reduce the risk of suffocation, resistance to absorbing fluid, and quick-drying. The ordinarily skilled artisan would appreciate that various articles of manufacture having suitable configurations could be designed to accomplish such objectives including, but not limited to, pads, blankets, mats, positioning members, sleep positioners for individuals, such as infants, and support systems for infants and other individuals.

Figure 3B:
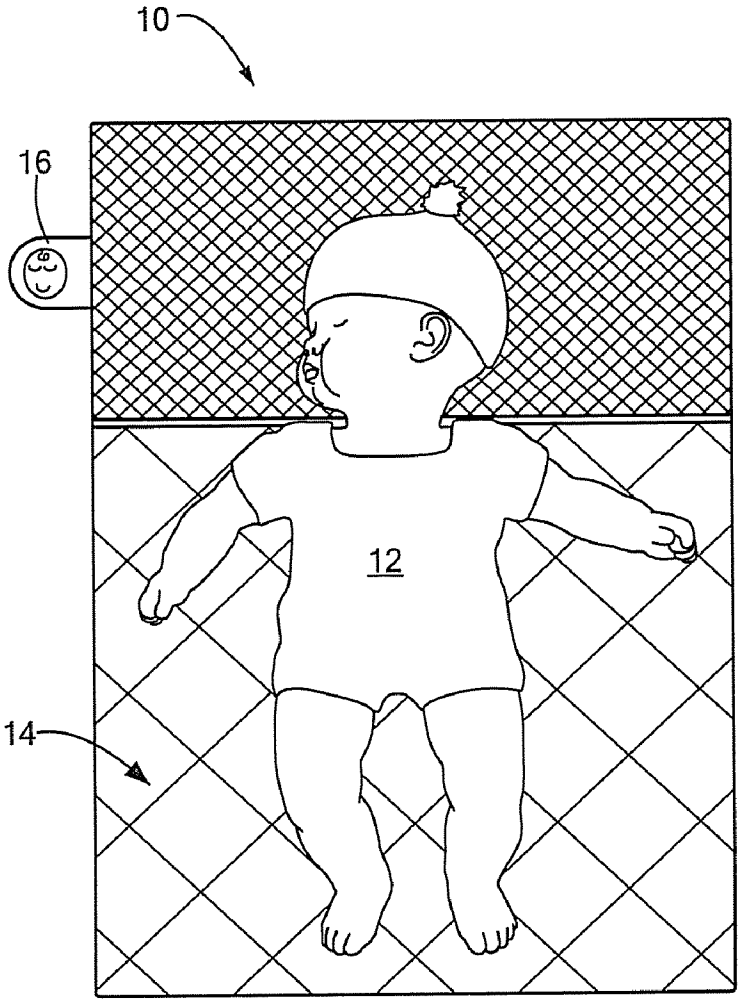
FIG. 3(*a*) is a top plan view of the infant sleep aid shown in FIG. 1, and with the infant depicted in a first sleep position.
Figure 3A:
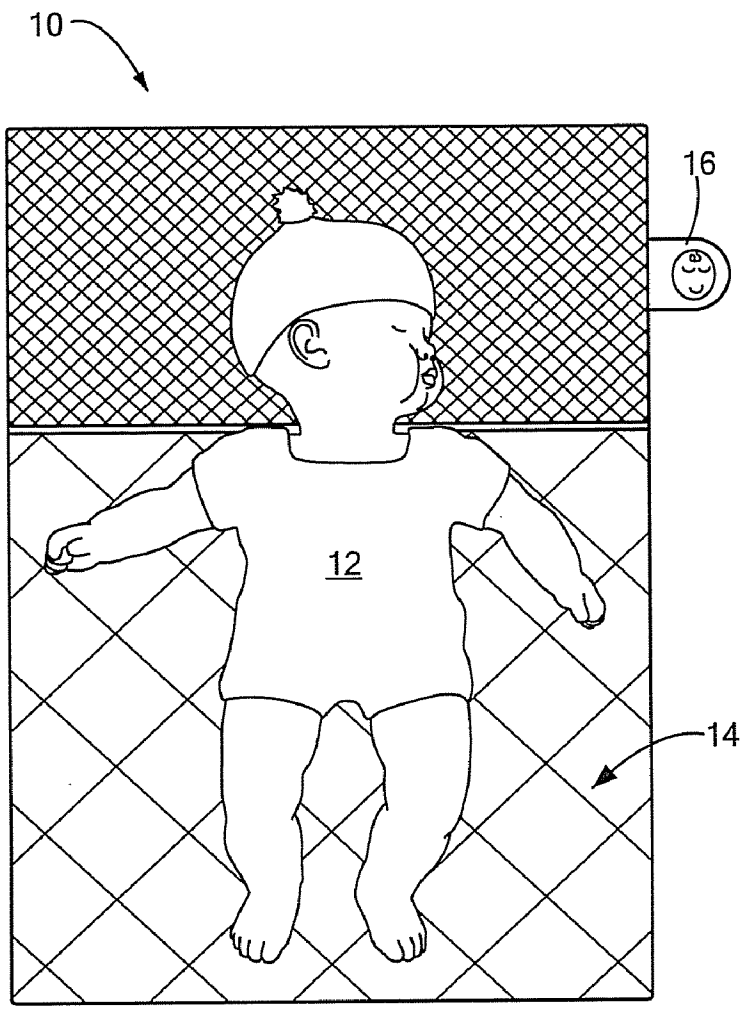

Refer now to FIGS. 3(*a*), 3(*b*) and 4 which introduce certain characteristics of the sleep position indicator 16 and its use in conjunction with cushion 14 to create the sleep aid 10.

Sleep position indicator 16 is preferably an elongate member which is movable relative to the cushion between first and second positions corresponding to first and second sleep positions for the infant. Thus, as shown in FIG. 3(*a*), sleep position indicator 16 is in a first position relative to cushion 14 so that it provides a directional reminder of how to orient the infant 12 during sleep. FIG. 3(*b*) shows the sleep position indicator 16 moved into a second position to provide a second directional reminder for orienting the infant 12. It has been found, as mentioned above in the background section, that plagiocephaly can be prevented, or its risk reduced, by alternating infants between sleeping positions such as shown in FIGS. 3(*a*) and 3(*b*). However, those who have raised children are intimately familiar with the arduous task at hand. When a parent is immersed in trying to handle the numerous responsibilities involved, it can be difficult to keep one's mind focused on a baby's sleeping position when even one child is involved, let alone multiples. Accordingly, the invention, in one of its forms as described herein, provides a convenient reminder system which can greatly facilitate this process.

Thus, if an infant is placed in an initial sleeping position in which he/she is facing the left side (from the prospective of the infant), the sleep position indicator 16 can be moved to a corresponding position (i.e. the right side as viewed from the top in FIG. 3(*a*)) so that it visibly protrudes from the right side of the cushion 14. The sleep position indicator 16 can then be moved to its second position as shown in FIG. 3(*b*) so that a caretaker is reminded that the infant 12 should be placed such that he/she is facing the right side during the next sleeping interval. Depending on a caretaker's particular preference, the sleep position indicator 16 could be moved prior, during, or after a given sleep interval to serve as a reminder of either the previous or next orientation for the infant.

Figure 4:
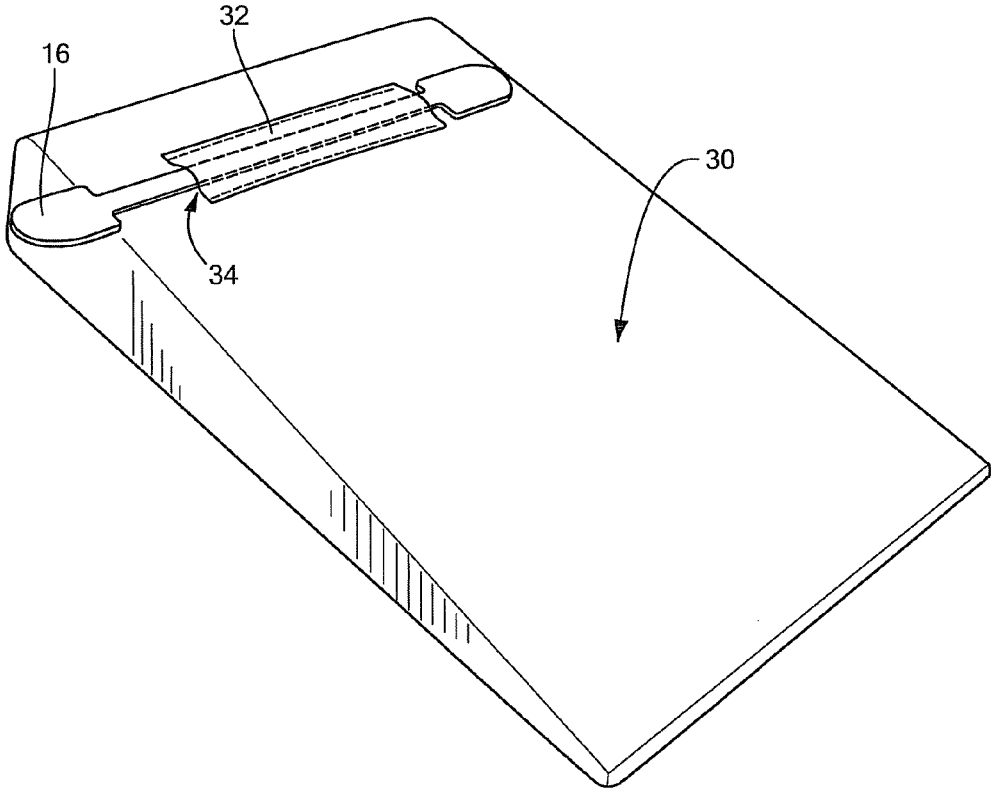
FIG. 4 is a bottom perspective view of the infant sleep aid with its sleep position indicator in a first position as shown in FIG. 3(*a*)

With the above understanding in mind, a preferred construction for locating the sleep position indicator 16 relative to the cushion is shown in FIG. 4. Here, sleeve 32 is sewn or otherwise affixed to the covering's bottom panel 30 to provide a slideway 34 along which the sleep position indicator 16 travels between the first and second reminder positions. Of course, one or more suitably sized loops could also be used in place of an elongate sleeve to create a slideway.

Figure 5:
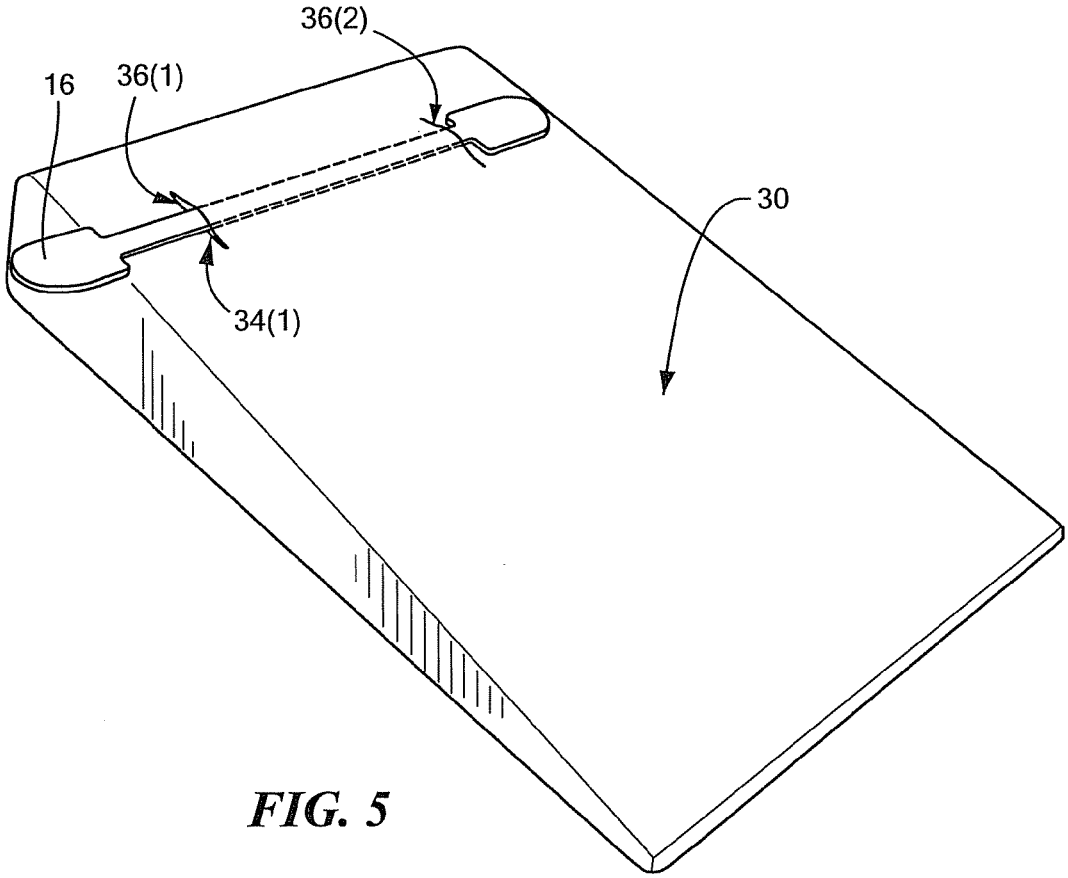
FIG. 5 is a bottom perspective view of an alternative construction for the first exemplary embodiment of the infant sleep aid.

An alternative construction which has been contemplated is shown in FIG. 5 wherein spaced-apart button holes 36(1) and 36(2) are formed in the bottom panel to define a slideway 34(1) between bottom panel 30 and the interior foam along which the sleep position indicator 16 travels. In each of the constructions illustrated in FIGS. 4 and 5, it may be appreciated that sleep position indicator 16 spans a majority of a dimension of the cushion, in this case its shorter transverse width. However, other configurations for sleep aids are contemplated which could benefit from along a longitudinal dimension of the cushion. Such a construction, for example, is taught in U.S. Pat. No. 7,213,281 B2, issued May 8, 2007 and assigned to the Alfred E. Mann Institute for Biomedical Engineering at the University of Southern California, the disclosure of which is also incorporated by reference in its entirety. Of course, the artisan should appreciate that an elongate, slideable sleep position indicator such as described in the present application could be incorporated into the bottom panel or other area of the infant positioner without departing from the inventive concepts contained herein.

Figure 6:
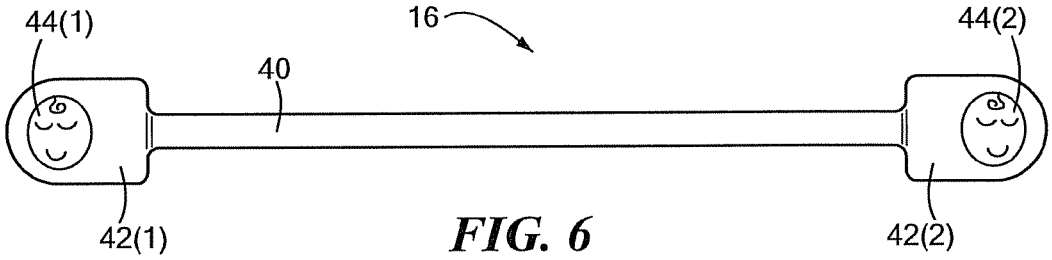
FIG. 6 is a top plan view of the sleep position indicator for use with the various embodiments described herein.
Figure 7:
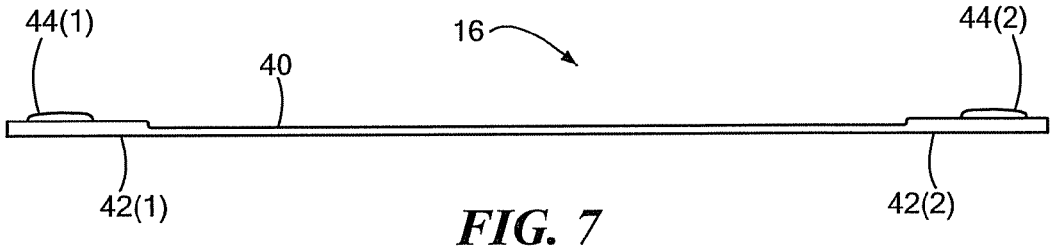
FIG. 7 is a front view in elevation of the sleep position indicator introduced in FIG. 6.

Refer now to FIGS. 6 and 7 which illustrate a preferred construction for the sleep position indicator 16. Sleep position indicator 16 is an elongate symmetrical construction having a narrow band portion 40 and a pair of opposed, and relatively enlarged, tabs 42(1) and 42(2) joined to band portion 40. Depending on one's perspective, tab 42(1) can be considered the left tab, while tab 42(2) can be considered the right tab. Band 40 serves as a slider to allow sleep position indicator 16 to move between the first and second (i.e. left and right) reminder positions as discussed above. It is, therefore, preferred that the tabs be enlarged relative to the band, as best shown in FIG. 6, to prevent inadvertent removal of the sleep position indicator from the slideway in which its band travels. As also shown in FIG. 6, each of the tabs 42(1) and 42(2) includes indicia to assist in reminding a caretaker of the next or previous position intended for the infant, whichever the case may be. Thus, left tab 42(1) includes indicia 44(1) corresponding to an infant's head facing to the left, while right tab 42(2) is provided with indicia 44(2) corresponding to an infant's head facing to the right. As may be appreciated with reference to FIG. 7, each of the indicia 44(1) and 44(2) may be formed as raised portions on their respective tabs 42(1) and 42(2). Of course, various other constructions for the sleep position indicator 16 are contemplated which would be suitable for accomplishing the purposes described herein. For example, relief indicia, as opposed to raised indicia, could be provided. The indicia could be accomplished by a suitable sticker or other material affixed to the tabs and, of course, other types of indicia could be provided such as "N" to indicate the next orientation for the baby or "P" to indicate the previous position for the baby. Indeed, the shapes of the tabs themselves could provide the suitable reminder system. For example, the tabs could be configured as arrow heads to indicate position.

A suitable material for sleep position indicator 16 is a food grade rubber or plastic so that it has the characteristics of being able to be cleaned. Furthermore, it is preferred that the material have some degree of flexibility so that the tabs can be manipulated to allow for insertion and removal of the indicator relative to the cushion where a construction, such as employed above, is provided where the tabs are enlarged relative to the sleeve or button holes. A thermoplastic elastomer of choice is commonly marketed under the designation 95A TPE.

Figure 8:
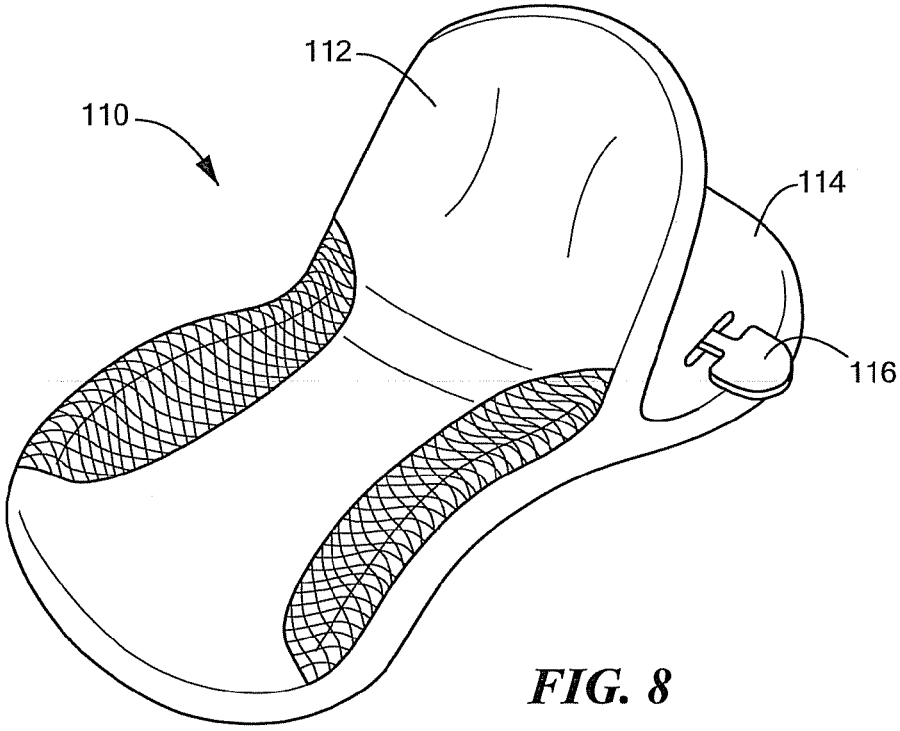
FIG. 8 is a perspective view of a second exemplary embodiment for an infant sleep aid.
Figure 9:
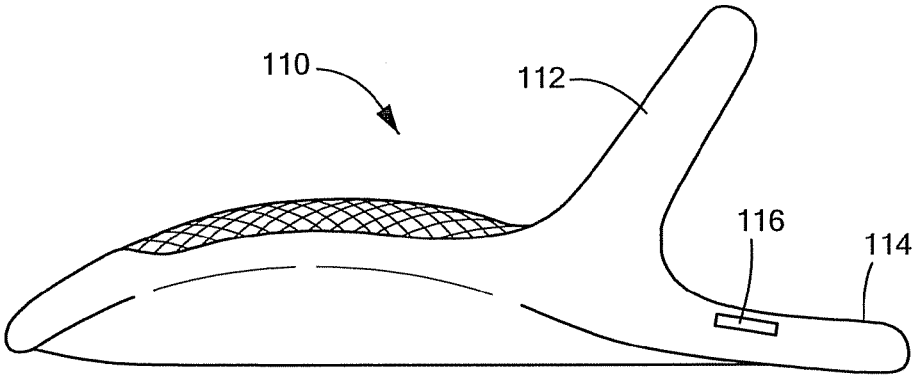
FIG. 9 is a right side view in elevation of the infant sleep aid shown in FIG. 8.

With the foregoing in mind, alternative constructions for sleep aids which are contemplated are briefly discussed with reference to the remaining figures. In FIGS. 8 and 9, a sleep aid 110 is illustrated which preferably corresponds to that described in my co-pending application Ser. No. 12/013,382, filed Jan. 11, 2008 and entitled FORMABLE SLEEP POSITIONER ALONG WITH METHOD FOR ADJUSTING SAME. Sleep aid 110 is in the form of an adjustable infant sleep positioner which can have its head portion 112 inclined relative to its base 114. Here, sleep position indicator 116 may be suitably provided so that it spans transversely across the positioner in a slideway formed in base portion 114, as representatively shown.

Figure 10:
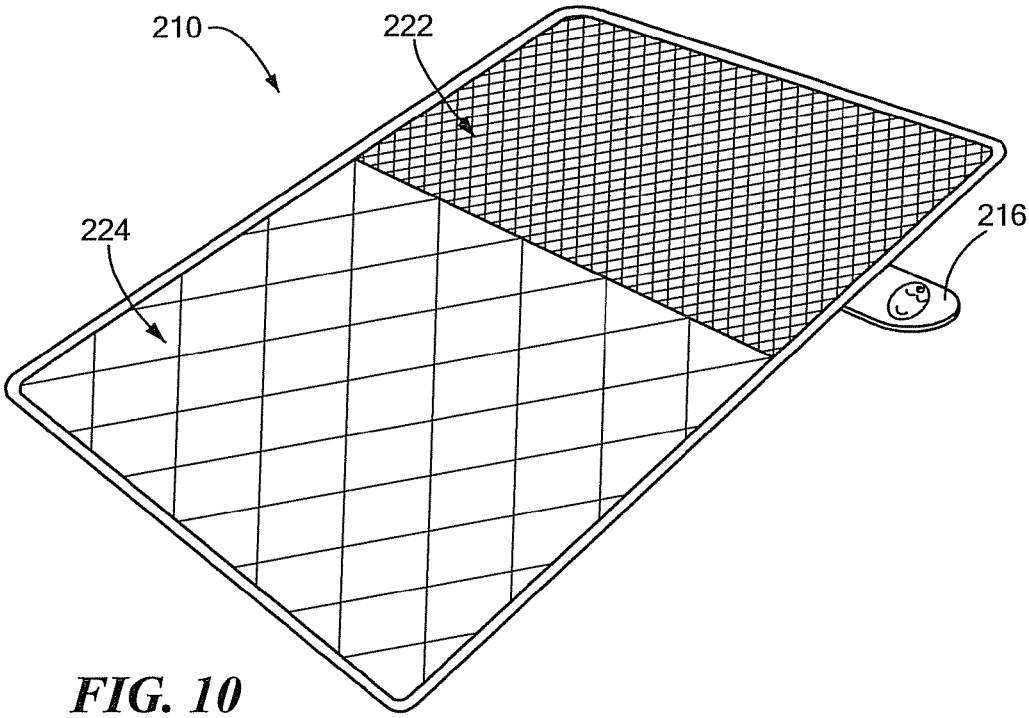
FIG. 10 is a perspective view of a third exemplary embodiment of an infant sleep aid.
Figure 11:
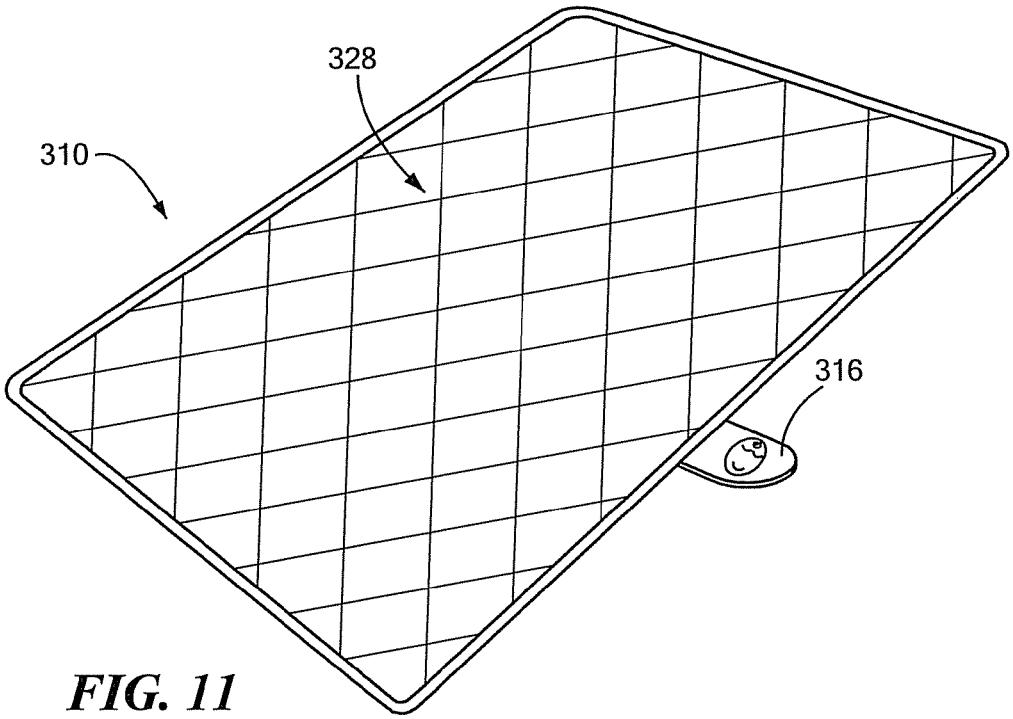
FIG. 11 is a perspective view of a fourth exemplary embodiment of an infant sleep aid.

Other forms of sleep aids are shown in FIGS. 10 and 11 to be in the form of substantially planar pads. In FIG. 10, sleep aid 210 is constructed as a thin pad having a head portion 222 and a foot portion 224 as discussed above, along with the sleep position indicator 216 projecting laterally from the head portion 222. Sleep aid 310, on the other hand, is formed as a thin pad with its entire top panel 328 corresponding to that discussed above with reference to foot panel portion 24 (see FIG. 2). Here, sleep position indicator 316 runs medially along the longitudinal side edge(s) of the sleep aid. The sleep aids of FIGS. 10 and 11 illustrate that any suitably configured pad, or even a sheet, could be devised and constructed to allow for the use of a sleep position indicator as described. Thus, the teachings herein should not be unduly limited to any particular construction for the cushions, pads, sheets, etc. which incorporate the sleep position indicator.

With the foregoing in mind, a method is also contemplated for recording one of a next or previous sleep positions for an individual, such as an infant or other person in need of assistance. According to the method, a sleep aid is provided having a sleep support and a sleep indicator. The sleep indicator is operative to move between one of a first position to indicate a first sleeping orientation for the individual and a second position to indicate a second sleeping orientation for the individual. The support may be a panel piece, but is preferably configured as a pad or cushion, and the sleep position indicator is mounted for travel relative to the support. Even more preferably, the sleep position indicator is an elongate member that travels between the first and second positions in a direction which is transverse to the longitudinal orientation of the individual and incorporates indicia to visually inform the previous or next sleep positions. Other features of the various methods contemplated by the present invention should be readily recognized from the previous description of the exemplary embodiments.

Accordingly, the present invention has been described with some degree of particularity directed to the exemplary embodiments thereof. It should be appreciated, though, that the present invention is defined by the following claims construed in light of the prior art so that modifications or changes may be made to the exemplary embodiments of the present invention without departing from the inventive concepts contained herein.

What is claimed is:

1. An infant sleep aid for use in reducing a risk of plagiocephaly, comprising:

a. an unconstrained cushion for placement directly on a support surface, including:

i. an elongate pad having a selected configuration which is sized and adapted to accommodate an infant when placed thereon in a reposed position such that the infant extends along a longitudinal axis of the pad; and ii. a flexible casing enveloping said pad to cover a top surface thereof, said casing having a bottom panel for confronting the support surface and a top panel providing a support surface for the infant when placed thereon, said top panel in facing relation to an upper surface of said pad and having a head portion; and b. a sleep position indicator slideably supported within said casing and having an elongate dimension that is greater than a width of said head portion, a medial portion of said sleep position indicator restricted for movement transversely to said longitudinal axis within a slideway, and is moveable between a first position wherein a first end portion of said sleep position indicator visibly protrudes from a first side of said cushion to point in a first transverse direction which informs a first head orientation for the infant, and a second position wherein a second end portion of said sleep position indicator visibly protrudes from a second side of said cushion to point in a second transverse direction which informs a second head orientation for the infant.

2. A method for reducing risk of plagiocephaly in an infant, comprising:

a. providing an elongate unconstrained cushion of a selected configuration, said cushion comprising a resilient pad and a flexible casing enveloping said pad, said casing having a top panel facing an upper surface of said pad for supporting an infant when placed thereon;

b. providing a sleep position indicator which is restricted for movement in a direction transverse to a longitudinal axis of said cushion, and being slidably moveable between a first position to point in a first transverse direction which visually informs a first head position for the infant, and a second position to point in a second transverse direction which visually informs a second head position for the infant;

c. placing the sleep position indicator in one of the first and second positions;

d. placing the infant in a reposed position on the support surface such that the infant's head is situated on a first end portion of the cushion and is oriented in one of the first transverse direction and the second transverse direction;

e. waiting a selected interval of time;

f. moving the sleep position indicator to another of the first and second positions; and g. re-situating the infant in a reposed position on the support surface such that the infant's head is situated on the first end portion of the cushion and is oriented in another of the first and second transverse directions.

3. An infant sleep positioner, comprising:

a. a cushion having a selected size and configuration for accommodating an infant on an upper surface thereof, said cushion including a flexible casing enveloping a pad to cover a top surface thereof; and b. a sleep position indicator supported by said casing and capable of being situated beneath a plane which contains said upper surface, said sleep position indicator being slidably movable between a first position to visually inform a first head position for the infant and a second position to visually inform a second head position for the infant.

4. A method according to claim 3 whereby step (f) occurs after step (e).

5. An infant sleep positioner according to claim 3 wherein said sleep position indicator is situated entirely beneath said plane.

6. A method according to claim 3 whereby step (f) occurs before step (e).

7. An infant sleep positioned according to claim 3 wherein said cushion is elongate and extends along a longitudinal axis, and wherein said sleep position indicator includes an indicator surface which extends transversely to said longitudinal axis when the sleep position indicator is in either the first position or the second position.

8. An infant sleep position indicator according to claim 3 wherein said sleep position indicator includes first indicia corresponding to a first head position of the infant, and second indicia corresponding to a second head position of the infant.

9. An infant sleep positioner according to claim 8 wherein each of said first indicia and said second indicia includes a depiction of an animal's head for respectively informing first and second head positions of the infant with respect to said infant sleep positioner.

10. An infant sleep positioner according to claim 3 wherein said cushion extends along a longitudinal axis, and wherein said sleep position indicator has a single piece, unitary construction which is movably disposed in opposite directions that are each transverse to the longitudinal axis.

11. An infant sleep position indicator according to claim 3 wherein said cushion extends along a longitudinal axis, and wherein said sleep position indicator is movable so as to point in a first direction which is transverse to said longitudinal axis, thereby informing the first position for the infant, and an opposite second direction which is transverse to the longitudinal axis, thereby to inform the second position for the infant.

12. An infant sleep positioner for supporting an infant on a support surface, comprising:

a. a cushion including a pad of selected size and configuration, said pad having a lower surface adapted to confront the support surface and an upper surface opposite the lower surface, said upper surface oriented at an acute angle with respect to said lower surface such that said upper surface is inclined relative to the support surface along a longitudinal axis extending between first and second end portions of said pad; and b. a sleep position indicator slidably movable between a first position wherein said sleep position indicator projects away from a periphery of the cushion to extend in a first direction that is transverse to the longitudinal axis, thereby to inform a first position of the infant with respect to the infant sleep positioner, and a second position wherein said sleep position indicator projects away from the cushion's periphery to extend in a second direction that is transverse to the longitudinal axis, thereby to inform a second position of the infant with respect to the infant sleep positioner; and c. at least a first positioning member of a selected size and configuration supported on the upper surface of said pad.

13. An infant sleep positioner according to claim 12 wherein said sleep position indicator is detached from said pad.

14. An infant sleep positioner according to claim 12 further comprising a second positioning member of a selected size and configuration supported on the upper surface of said pad, at least one of said first and second positioning members being releasably attached relative to said cushion.

15. An infant sleep positioner according to claim 12 wherein a first side of said sleep position indicator includes first indicia corresponding to a first head position of the infant when the infant's head is situated on a first end portion of the cushion, and a second side of said sleep position indicator includes second indicia corresponding to a second head position of the infant when the infant's head is situated on the first end portion.

16. An infant sleep positioner according to claim 15 wherein each of said first indicia and said second indicia includes a depiction of an animal's head for respectively informing first and second head positions of the infant with respect to the infant sleep positioner.

17. An infant sleep positioner according to claim 12 wherein said sleep position indicator is flexible.

18. An infant sleep positioner according to claim 12 wherein said sleep position indicator is located proximate to a first end portion of said pad beneath a plane which contains an upper surface of said cushion.

* * * * *

UNITED STATES PATENT AND TRADEMARK OFFICE

CERTIFICATE OF CORRECTION

PATENT NO. : 7,886,384 B2
APPLICATION NO. : 12/014645
DATED : February 15, 2011
INVENTOR(S) : John Lord It is certified that error appears in the above-identified patent and that said Letters Patent is hereby corrected as shown below:

Col. 8, in Claim 4, Line 33

Replace "claim 3"
With "claim 2"

Col. 8, in Claim 6, Line 38

Replace "claim 3"
With "claim 2"

Signed and Sealed this
Ninth Day of August, 2011

David J. Kappos

David J. Kappos
*Director of the United States Patent and Trademark Office*